US011444371B2

(12) United States Patent
Zhu et al.

(10) Patent No.: US 11,444,371 B2
(45) Date of Patent: Sep. 13, 2022

(54) ANTENNA FOR WEARABLE DEVICES

(71) Applicant: Google LLC, Mountain View, CA (US)

(72) Inventors: Jiang Zhu, Cupertino, CA (US); Paul Biggins, Mountain View, CA (US); Zheyu Wang, San Jose, CA (US)

(73) Assignee: Google LLC, Mountain View, CA (US)

( * ) Notice: Subject to any disclaimer, the term of this patent is extended or adjusted under 35 U.S.C. 154(b) by 346 days.

(21) Appl. No.: 16/260,399

(22) Filed: Jan. 29, 2019

(65) Prior Publication Data

US 2020/0243952 A1 Jul. 30, 2020

(51) Int. Cl.

| | |
|---|---|
| ***H01Q 1/27*** | (2006.01) |
| ***G04R 60/06*** | (2013.01) |
| ***H01Q 7/00*** | (2006.01) |
| ***H01Q 9/40*** | (2006.01) |
| ***G04R 60/02*** | (2013.01) |

(52) U.S. Cl.

CPC ..... *H01Q 1/273* (2013.01); *G04R 60/02* (2013.01); *G04R 60/06* (2013.01); *H01Q 7/00* (2013.01); *H01Q 9/40* (2013.01)

(58) Field of Classification Search

CPC . H01Q 1/273; H01Q 7/00; H01Q 9/40; G04R 60/02; G04R 60/06

See application file for complete search history.

(56) References Cited

U.S. PATENT DOCUMENTS

| | | | | |
|---|---|---|---|---|
| 2016/0254587 | A1* | 9/2016 | Jung | H01Q 7/00 343/702 |
| 2017/0133752 | A1* | 5/2017 | Choi | H01Q 1/241 |
| 2018/0083342 | A1* | 3/2018 | Lepe | H01Q 1/243 |
| 2019/0265655 | A1* | 8/2019 | Naka | G04R 60/12 |
| 2019/0305424 | A1* | 10/2019 | Wang | H01Q 9/42 |
| 2019/0350319 | A1* | 11/2019 | Li | A44C 5/145 |

OTHER PUBLICATIONS

Author: Wei Wang, Title: Electronic Device, Mar. 2018, p. 1-10 (Translation) (Year: 2018).*

Author: Wei Wang, Title: Electronic Device, Mar. 2018, p. 1-15 (Year: 2018).*

* cited by examiner

*Primary Examiner* — Wei (Victor) Y Chan

(74) *Attorney, Agent, or Firm* — Lerner, David, Littenberg, Krumholz & Mentlik, LLP

(57) ABSTRACT

An antenna is provided for a wearable personal computing device, such as a smartwatch. The antenna integrates with other components of the wearable device, such as a second antenna. For example, the first antenna may be a coupled loop antenna in proximity to a second antenna that may be a monopole antenna, without causing interference between the two antennas. In one example, the first antenna shares a common ground with the second antenna.

21 Claims, 7 Drawing Sheets

ANTENNA FOR WEARABLE DEVICES

BACKGROUND

Many modern wrist-worn devices, including wearable bands and smartwatches, have wireless network, short range wireless pairing, and global positioning system ("GPS") communication functions. Antenna design for wrist-worn devices can be very challenging because of the limited space and constrained form factors of such devices. With the limited space of a smartwatch, there may be a relatively small distance between the antenna and a ground plane. Nonetheless, sufficient clearance between the antenna and ground plane is typically required to maintain the antenna's radiation performance, such as radiation efficiency and antenna bandwidth. Antenna clearance may be increased by increasing the overall size of the product or decreasing the size of other components, for example the battery which may, depending on the circumstances, be contrary to certain design and user preferences.

Wrist-worn devices, when worn, are typically placed in close proximity to the user's skin. As such, the antennas within the smartwatch face additional challenges, such as body effects from close proximity to the skin. The antenna performance can depend on the size of its ground plane, e.g., when the housing serves as the antenna ground, the housing may have a large impact on antenna performance if the antennas are not properly designed.

BRIEF SUMMARY

The present disclosure provides for an antenna design for a wearable computing device, such as a smartwatch. The two antennas, a coupled loop antenna and a monopole antenna, are located around the periphery of the housing and in relative proximity to one another.

One aspect of the disclosure provides an antenna having an inner trace, where the inner trace has a first and second end and the first end is configured to serve as a feed for the antenna, and an outer trace, where the outer trace has a first and second end and the first end of the outer trace is positioned adjacent to the second end of the inner trace, wherein the inner and outer trace are positioned along a periphery of a wearable device and coupled to a ground, and wherein the antenna is a coupled loop antenna.

Another aspect of the disclosure provides a wearable device having a housing, a cover, a carrier, and a first antenna for a first frequency band. The housing may be shaped to be worn on a human body and the housing may have at least one outer surface and an internal cavity wherein the at least one outer surface of the housing is shaped to come in contact with the human body. The cover may be configured to enclose the internal cavity of the housing and the carrier may be positioned within the internal cavity of the housing along a periphery of the internal cavity. The first antenna may be a coupled loop antenna attached to the carrier at a first location and may include an outer trace and an inner trace. The outer trace may have a first end and a second end wherein the first end is configured to serve as a feed for the first antenna. The inner trace may have a first end positioned adjacent to the second end of the outer trace.

Yet another aspect of the disclosure provides a system that includes a first antenna for a first frequency band and a second antenna for a second frequency. The first antenna may be a coupled loop antenna having an inner trace and an outer trace, the outer trace having a first end configured to serve as a feed for the first antenna. The second antenna may be a monopole antenna having a first end configured to serve as a feed for the first antenna. The first and second antennas may be positioned along a periphery of a wearable device and coupled to a common ground.

According to some examples, the wearable device may be a smartwatch. The smartwatch may include a housing and the housing may be insertable into a variety of different watch bands. The variety of different watch bands may, for example, be comprised of a variety of different materials. Thus, the first and second antennas may still achieve a threshold performance when inserted into each of the variety of watchbands and materials.

DETAILED DESCRIPTION

Overview

Figure 1:
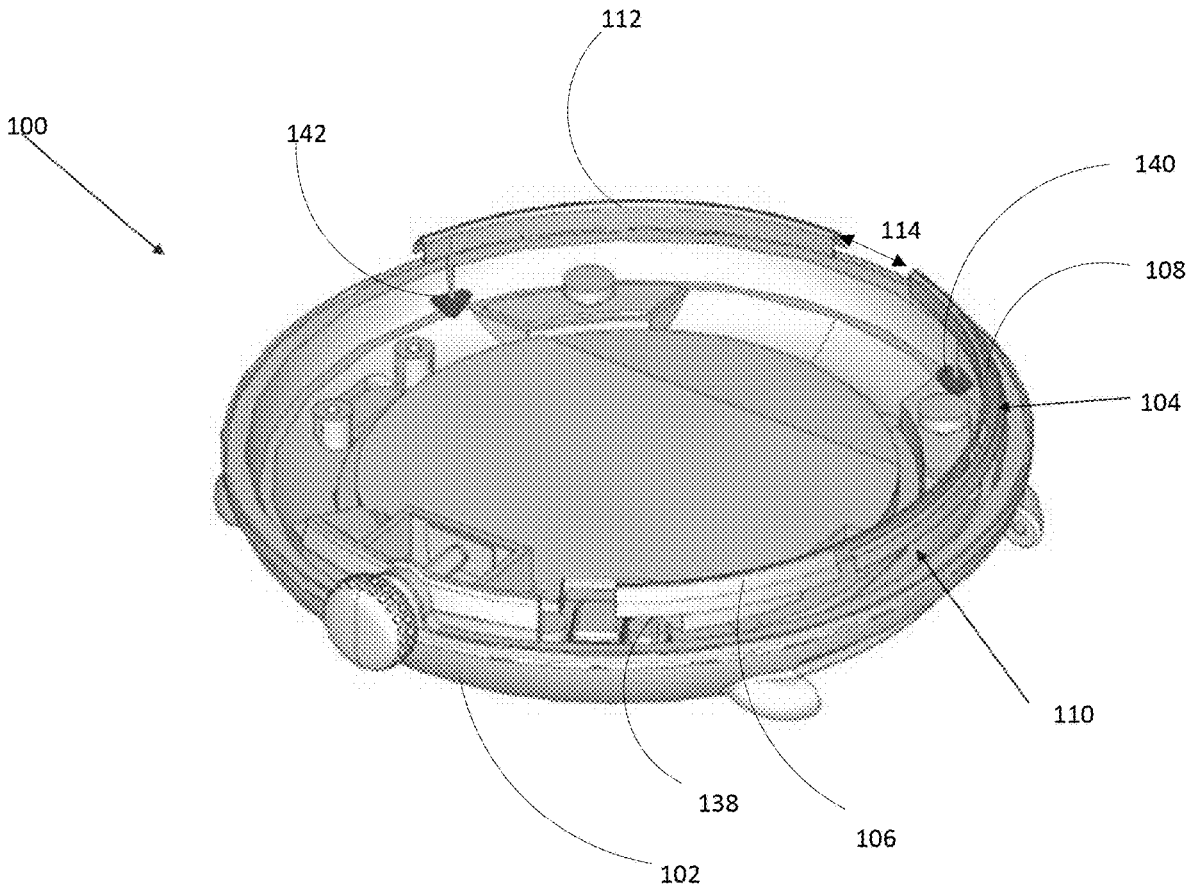
FIG. 1 is a perspective view of an example configuration of first and second antennas in a smartwatch according to aspects of the disclosure.

The present disclosure provides antenna systems that may be used, by way of example, in compact and highly integrated small form-factor devices such as wearable bands and smartwatches. For instance, the system may include a first coupled loop antenna having an inner and outer trace positioned along a periphery of a device and a second antenna positioned proximate to the first antenna. The system may be configured so that the first antenna operates within one frequency band and the second antenna operates within a different frequency band. For example, the first antenna may be used to receive GPS signals and the second antenna may be used to send and receive relatively short-range network communication signals, e.g., Wifi and Bluetooth signals.

The coupled loop antenna may be configured to receive GPS signals, e.g., 1575 Mhz signals. The coupled loop structure may provide improved efficiency and bandwidth compared to other GPS antenna structures, which may help compensate for loading effects. For example, the material (e.g., metal vs. non-metal) and shape of the components of a modular smartwatch may vary, and a typical monopole structure may be relatively more sensitive to the surrounding metal and dielectric material of the device. A typical monopole structure may also strongly excite the ground plane and adjacent metal surroundings, which may cause a change in the antenna's performances, e.g., its resonant frequency and radiation efficiency. In contrast, a coupled loop structure may localize the high frequency currents that give rise to electromagnetic radiation, lowering its sensitivity to other parts of the device's architecture.

The network communications antenna may be a monopole antenna. The network communications antenna may be a 2.4 GHz antenna.

Both antennas may be connected to a carrier, which is mounted inside a housing such as a smartwatch housing. The antennas may be located within proximity to one another. According to some examples, the carrier may extend to, and the antennas may be positioned around, the periphery of the housing. Yet further, the antennas may form a perimeter around other components within the housing such that the antennas are not covered by the other components. For example, the antennas may be plated on the carrier, such as by using laser direct structuring ("LDS") or other fabrication techniques, in a particular antenna pattern.

The housing may have a cover and further include at least one surface that is shaped to come in contact with a portion of the human body. The antenna, when plated on a carrier, may abut or nearly abut the cover of the housing. In some examples, the primary material used to form the cover and the remainder of the housing are the same. In other examples, the type of material from which the cover is formed (e.g., 3D glass or plastic) is different from the remainder of the housing (e.g., metal). While different materials may have different dissipation factors, the antenna design may compensate for losses due to the dissipation factor regardless of the type of material used for the cover.

The housing may be circular, oval, rectangular, or any other shape. In some examples, the housing shape may correspond to a recess in a modular watch band such that the smartwatch can be inserted or attached to the watch band. The watch band may be made of metal, plastic, rubber, leather or other materials.

Example Systems

FIG. 1 illustrates an example antenna design within an example wearable device. In this example, the wearable device is a smartwatch 100. However, it should be understood that the example antenna design may be implemented in any of a variety of wearable devices, such as earbuds, pendants, head-mounted displays such as smart glasses, etc.

Smartwatch 100 includes a housing 102. While in the example shown the housing 102 is round in shape and made of metal, housing 102 may be any shape, such as rectangular, square, oval, etc., and may be made out of a variety of materials, such as plastic, glass, fibers, or any combination of these or other materials. The shape of housing 102 may determine the location of the antennas along the perimeter.

At least one surface of housing 102 may be shaped to come in contact with a portion of a human body. For example, if the wearable device is a smartwatch, at least one surface of housing 102 may be in contact with a user's wrist. In other wearable devices, at least one surface of the housing may be in contact with other portions of the human body such as a person's head (e.g., the ears or above the ears), neck, ankle, etc.

The outer surface of the housing may be adapted to modularly attach to another component. For example, where the wearable device is a smartwatch, housing 102 may be adapted to attach to a modular watch band. In other examples, where the wearable device is a different device, the housing may be integrated or adapted to modularly attach to an eyeglass frame, necklace, ear insert, etc. The watch band may be made of metal, a suitable non-metal material, or a combination of such materials. The housing and watch bands may be different in shape and material, and the first antenna may promote high performance and efficiency relatively independently of the shape or material of the housing 102 or watch band. For example, when the first antenna is configured as a coupled loop antenna, the electrical current that is responsible for radiation may be circulated in a well-defined metal boundary independent of a modular part. A typical monopole antenna may strongly excite the metals in nearby modular metal parts. Efficiency may also be improved via the use of a highly resonant and high Q (quality factor) coupling structure. When the peak of the radiation efficiency is aligned with the relevant frequency band, antenna radiation efficiency may be generally improved relative to other antenna structures.

The housing may contain a first antenna 104 and a second antenna 112 that are configured to operate in different frequency bands. For example, the first antenna may provide improved performance (e.g., antenna efficiency and radiation pattern) when it is operated within a first frequency band and the second antenna may provide optimal performance when operated within a second frequency band that is different from the first frequency band. Optimal performance may directly affect transmission and reception quality.

The first antenna may be a coupled loop antenna that receives GPS signals and provides those signals to another component for decoding. The first antenna may concentrate the fields in a loop in order to decrease the amount of radiation that goes to the ground plane, e.g., a conductive surface. The coupled loop antenna may be fed from one end and grounded at the other end. Yet further, the coupled loop antenna may be located within the device so that its associated antenna beam tends to point skyward (e.g., towards a satellite) during normal use. The coupled loop antenna may provide improved bandwidth and efficiency compared to a monopole structure.

Figure 2:
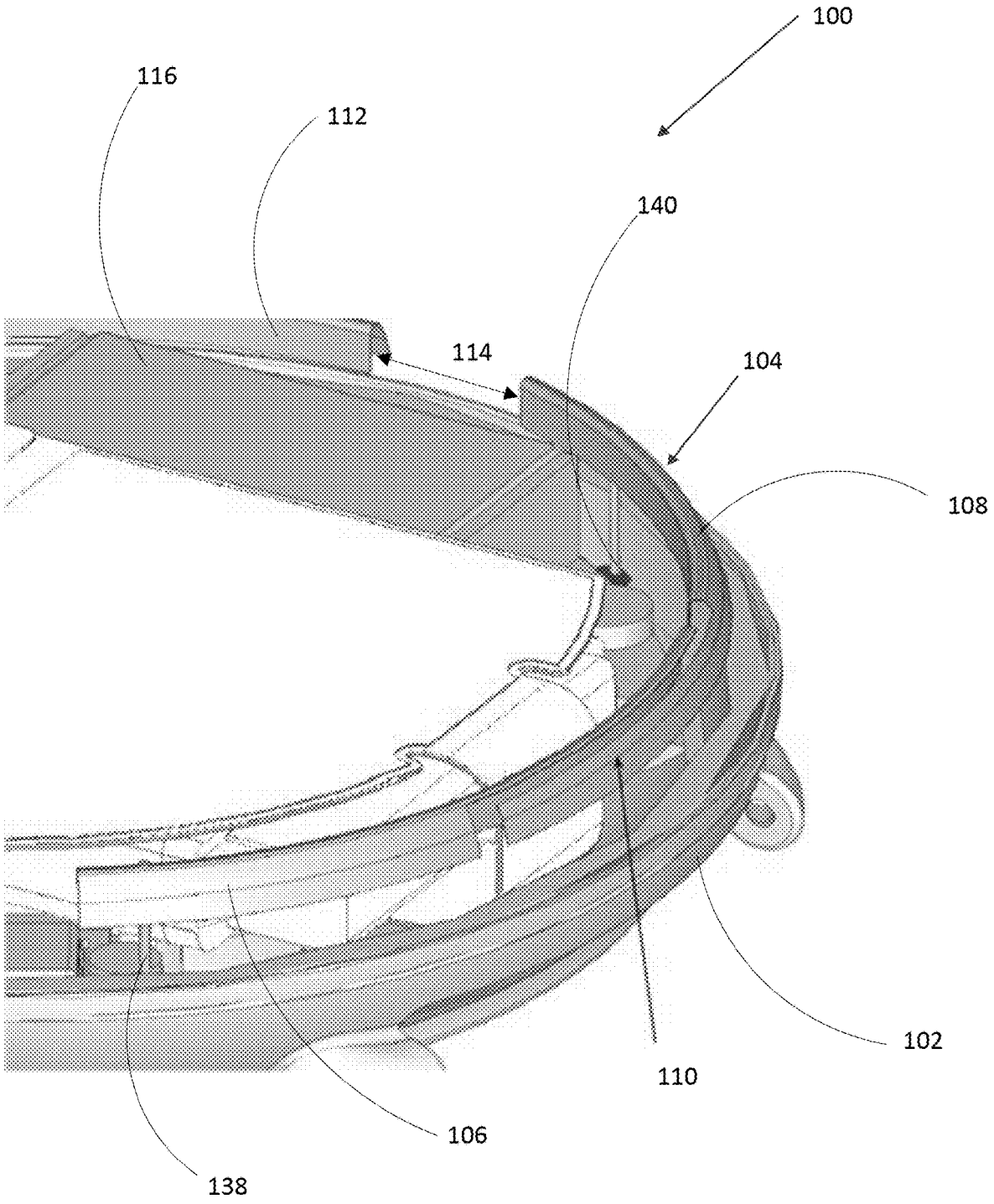
FIG. 2 is a detailed perspective view of the first antenna of FIG. 1.
Figure 5:
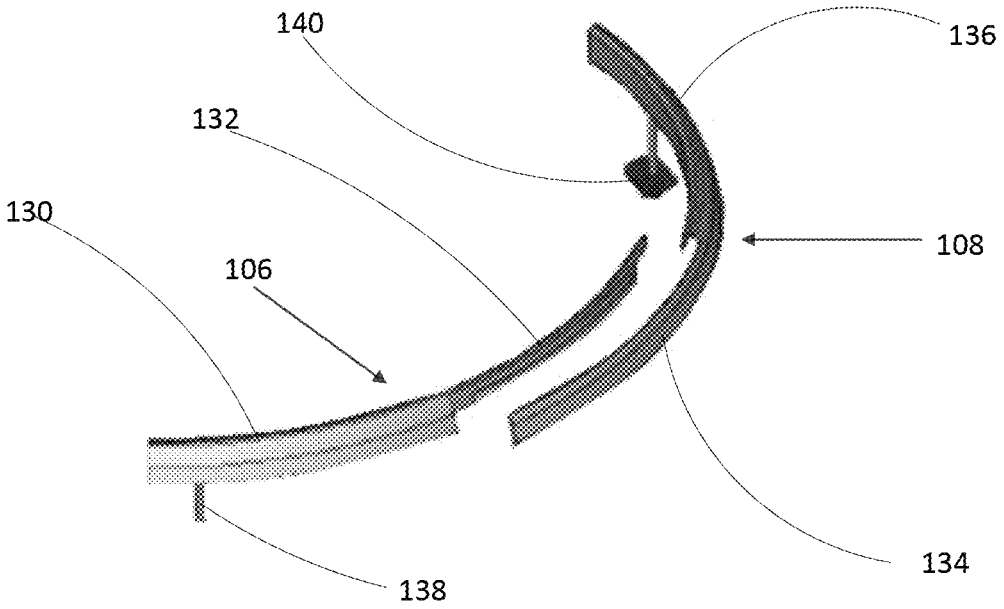
FIG. 5 is an exploded view of the configuration of an antenna in an example smartwatch according to aspects of the disclosure.

The first antenna may be a trace antenna that includes an inner trace and an outer trace. For example and as shown in FIG. 2, first antenna 104 may have an outer trace 108 and an inner trace 106. As also shown in FIG. 5, inner trace 106 and outer trace 108 may each have, respectively, a first portion 130, 134 and a second portion 132, 136. The second portion 136 of outer trace 108 is connected to a feed 140 of the first antenna 104. First antenna 104 may also include an antenna support 138. Antenna support 138 may also act as the ground for the first antenna 104.

The inner trace and outer trace of the first antenna may be coupled together. For example, portions of the inner trace may be aligned with, but not touch, portions of the outer trace within the housing. In that regard and as shown in FIG. 2, along a portion of the periphery of the device, second portion 132 of inner trace 106 may be disposed inward of (e.g., a radial distance away from) first portion 134 of outer trace 108. In other examples, the inner trace 106 and outer trace 108 may not be coupled. For example, the inner trace 106 and outer trace 108 may not align with each other but may still be located in close proximity to one another. According to still other examples, the second portion 132 of inner trace 106 may align with the first portion 134 of outer trace 108 on opposite sides, or legs, of the carrier 120 described below. In yet more examples, the coupled antenna may include three or more traces.

The second antenna may be a monopole antenna and function as an antenna for short-range network communications. For example, the second antenna may connect the device to a Wifi network or pair it with another device via Bluetooth. Second antenna 112 may be a 2.4 GHz antenna and have one of its two ends configured to serve as a feed 142.

The first antenna and second antennas may be located along the periphery of the housing. For instance, first antenna 104 may extend between one-fourth and one-half around the periphery of the wearable device. In other examples, first antenna 104 may extend more than one-half or less than one-fourth the periphery of housing 102. There may be a space 114 separating the first antenna 104 from the second antenna 112. According to some examples, the size of space 114 may be varied. For example, the first antenna 104 and second antenna 112 may be spaced relatively far, such as 0.46 mm or more. Alternatively, and particularly when the two antennas are different types of antennas and would not interfere with each other, the first and second antennas may be positioned adjacent one another such that an end of the first antenna 104 is touching or almost touching an end of the second antenna 112.

The first antenna 104 and second antenna 112 may share a common ground. For example, the common ground may be the housing 102. According to some embodiments, the first antenna 104 may be grounded via antenna support 138 and second antenna 112 may be grounded via a grounding component at feed 142.

The antennas may directly and indirectly provide and receive signals to and from other components within the housing of the device, such as Wifi modem, Bluetooth chip, GPS receiver, one or more microprocessors, and other components that permit the device to device to function as a smartwatch.

The other components may also include a haptic sensor, such as haptic sensor 116 shown in FIG. 2, which allows the user to feel tactile inputs and touch sensations. According to some examples, the haptic sensor 116 may be located within the perimeter created by the first antenna 104 and second antenna 112. The haptic sensor 116, along with various other components within the housing 102, may or may not touch the antennas. In addition to the antennas, the housing may contain components that permit the wearable device to be used as a smartwatch. The housing 102 may also contain a touch panel 118 and a display (not shown).

Figure 3:
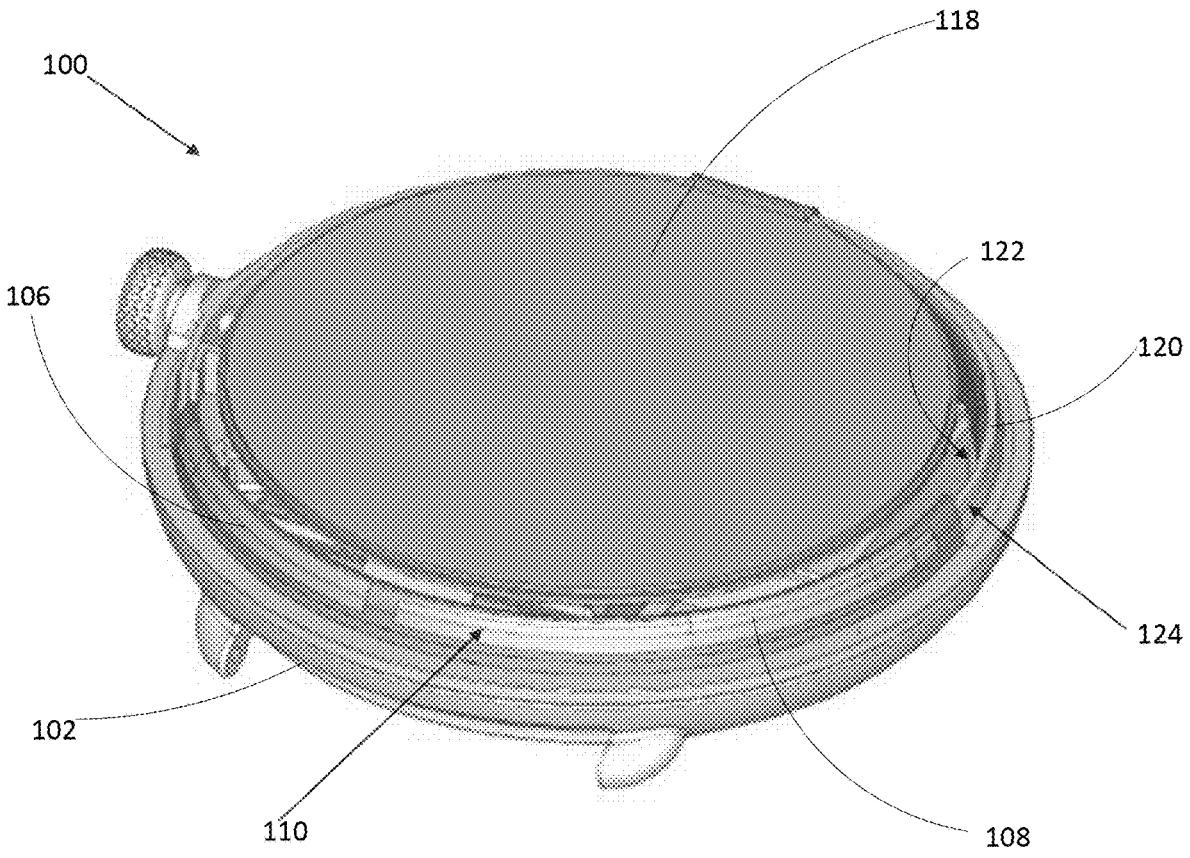
FIG. 3 is a detailed perspective view of an example configuration of the first antenna in relation to other internal components of the smartwatch according to aspects of the disclosure.

FIG. 3 provides a perspective view of the first antenna in relation to other internal components of the smartwatch 100, including the touch panel 118 and carrier 120. The touch panel may, for example, be used for receiving active user input. The carrier 120 may be located along the periphery of the housing 102 and may include an inner leg 122 and an outer leg 124. According to some examples, the inner leg 122 corresponds with the surface of the carrier 120 directed towards the center of the housing 102 and the outer leg 124 corresponds with the surface of the carrier 120 directed away from the center of the housing 102 and towards the periphery of the housing 102. The carrier 120 may extend around the entire periphery of housing 102. According to other examples, the carrier may extend around only part of the periphery of housing 102.

The antennas may be connected to the carrier 120 via laser direct structuring ("LSD"). Carrier 120 may be molded out of a resin that includes an additive suitable for LDS. A laser may then transfer the antenna pattern to the surface of the carrier 120. Finally, the carrier 120 may go through a metallization process, in which the antenna pattern is plated with the proper metal. Thus, according to some examples, the antennas may match the shape, including the curves, angles, etc., of carrier 120.

Figure 4A:
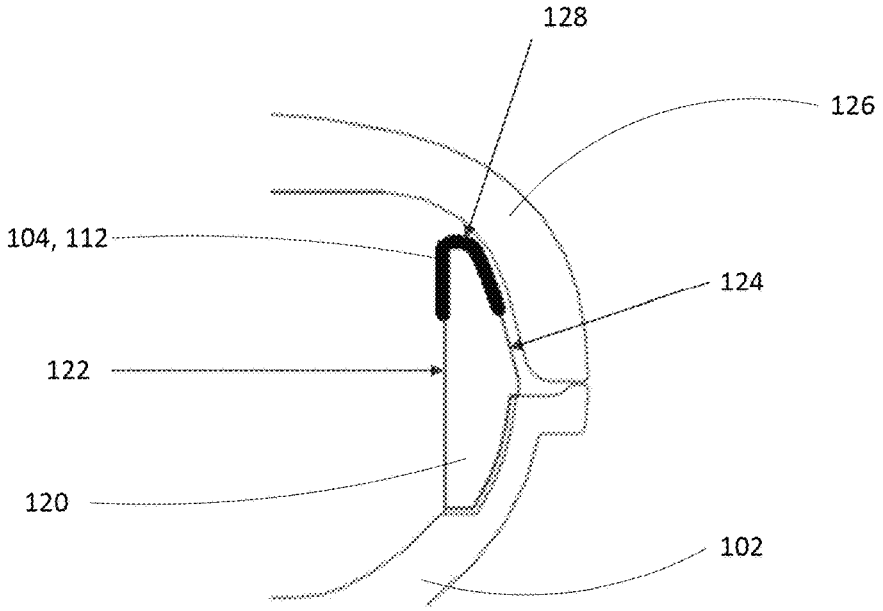
FIG. 4A is a cross-sectional view of an example antenna carrier according to aspects of the disclosure.
Figure 4B:
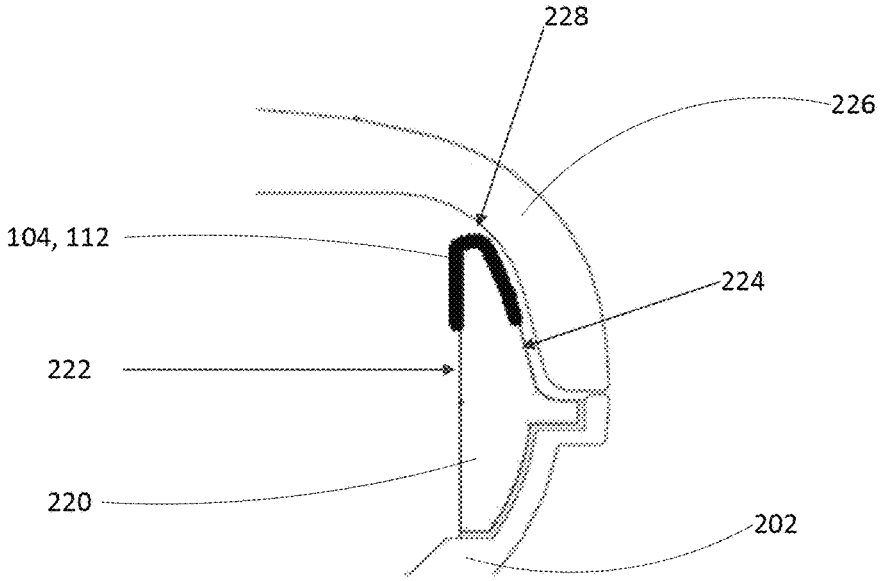
FIG. 4B is a cross-sectional view of another example antenna carrier according to aspects of the disclosure.

FIG. 4A illustrates one example of how carrier 120 may fit between the housing 102 and cover 126 and FIG. 4B illustrates another example of how carrier 220 may fit between the housing 202 and cover 226. The examples shown in FIGS. 4A and 4B show different amounts of LSD plastic and glue used to fill the space between the cover and the housing. For example, in FIG. 4A there is less LSD plastic and glue between housing 102 and cover 126 then between housing 202 and cover 226 in FIG. 4B. Cover 126, 226 may be complementary to housing 102. Carrier 120, 220 may be complementary to housing 102, 202 and cover 126, 226. For example, carrier 120, 200 may be located along the periphery of the housing 102, 202 such that the top of the carrier 120, 220 is complementary in size and/or shape to the inside surface and periphery of cover 126, 226. The bottom of carrier 120, 220 may be similarly complementary in size and/or shape to the inside surface and periphery of housing 102, 202. According to some examples and as seen in FIG. 4B, carrier 220 may also occupy some of the space where housing 202 abuts cover 226. The size and thickness of the housing 102, 202, cover 126, 226, carrier 120, 220 and antennas are shown for exemplary purposes in FIGS. 4A and 4B and are not to be construed as limited. The size and thickness of any of the components may be more or less according to some examples.

The carrier may, according to some examples, extend around the entire periphery of the housing. The inner leg 122, 222 of carrier 120, 220 may be substantially vertical with respect to the bottom surface of the housing 102, 202. The outer leg 124, 224 of carrier 120, 220 may be angled with respect to the inner leg 122, 222, such that the angle between the inner leg 122, 222 and outer leg 124, 224 may be an acute angle. The inner leg 122, 222 and outer leg 124, 224 of carrier 120, 220 may be connected via an arcuate surface 128, 228, such that where the inner leg 122, 222 and outer leg 124, 224 meet is not a sharp apex. The carrier 120, 220, may span the vertical distance between the housing 102, 202 and the cover 126, 226. While there are alternative configurations for the carrier 120, 220 within housing 102, 202, the remainder of this disclosure focuses on the first exemplary configuration shown in FIG. 4A.

The housing 102 may be enclosed by the cover 126. The cover 126 may be made of any suitable material that will receive input from a user's touch and allow the device to function as a smartwatch or other wearable device. For example, the cover 126 may be made of glass, plastic or the like, including but not limited to Corning® Gorilla® Glass 5 and Schott® Xensation® glass. According to some examples, the first antenna 104 and second antenna 112 may touch or almost touch the interior surface of the cover 126.

The antennas may be configured to compensate for the dissipation factor of the material of the cover 126. Therefore, according to some examples, the use of a coupled loop antenna may compensate for the loading effect on modularity caused by the cover 126 due to the antenna's improved bandwidth and efficiency relative to other types of antennas.

FIG. 5 is an exploded view of the configuration of the first antenna 104. According to some embodiments, the inner trace 106 and outer trace 108 may be coupled together via a coupling structure 110. Coupling structure 110 may be formed between the inner trace 106 and outer trace 108 of the first antenna 104. The inner trace 106 may have a first portion 130 and a second portion 132. The first portion 130 of the inner trace 106 may cover a portion of both the inner leg 122 and outer leg 124 of carrier 120 and may be connected over the arcuate surface 128. The second portion 132 of inner trace 106 may cover a portion of the inner leg up to the arcuate surface 128 of carrier 120. The outer trace 108 may also have a first portion 134 and a second portion 136. The first portion 134 of outer trace 108 may cover a portion of both the inner leg 122 and outer leg 124 of carrier 120 and may be connected over the arcuate surface 128. The second portion 136 of outer trace 108 may cover a portion of the outer leg 124 up to the arcuate surface 128 of carrier 120.

According to some examples, when the inner trace 106 and outer trace 108 are templated onto the carrier 120, the second portion 132 of inner trace 106 will be on the inner leg 122 of carrier 120 while the first portion 134 of outer trace 108 will be on the outer leg 124 of carrier 120 such that the second portion 132 and first portion 134 oppose each other on carrier 120. Although the first antenna 104 is comprised of inner trace 106 and outer trace 108, the first antenna 104 may effectively cover an entire portion of carrier 120. For example, the inner trace 106 and outer trace 108 may not touch each other, but the second portion 132 of the inner trace 106 may align with the first portion 134 of outer trace 108 on opposite sides of carrier 120. The coupling structure 110 may be located where the first portion 134 of outer trace 108 and second portion 132 of inner trace align. The second antenna 112 may cover both the inner leg 122 and outer leg 124 and the arcuate surface 128 of carrier 120 for the entire length of the antenna. In other examples, the second antenna 112 may cover any combination of the inner leg 122, outer leg 124 and arcuate surface 128 throughout the length of the antenna.

Figure 6:
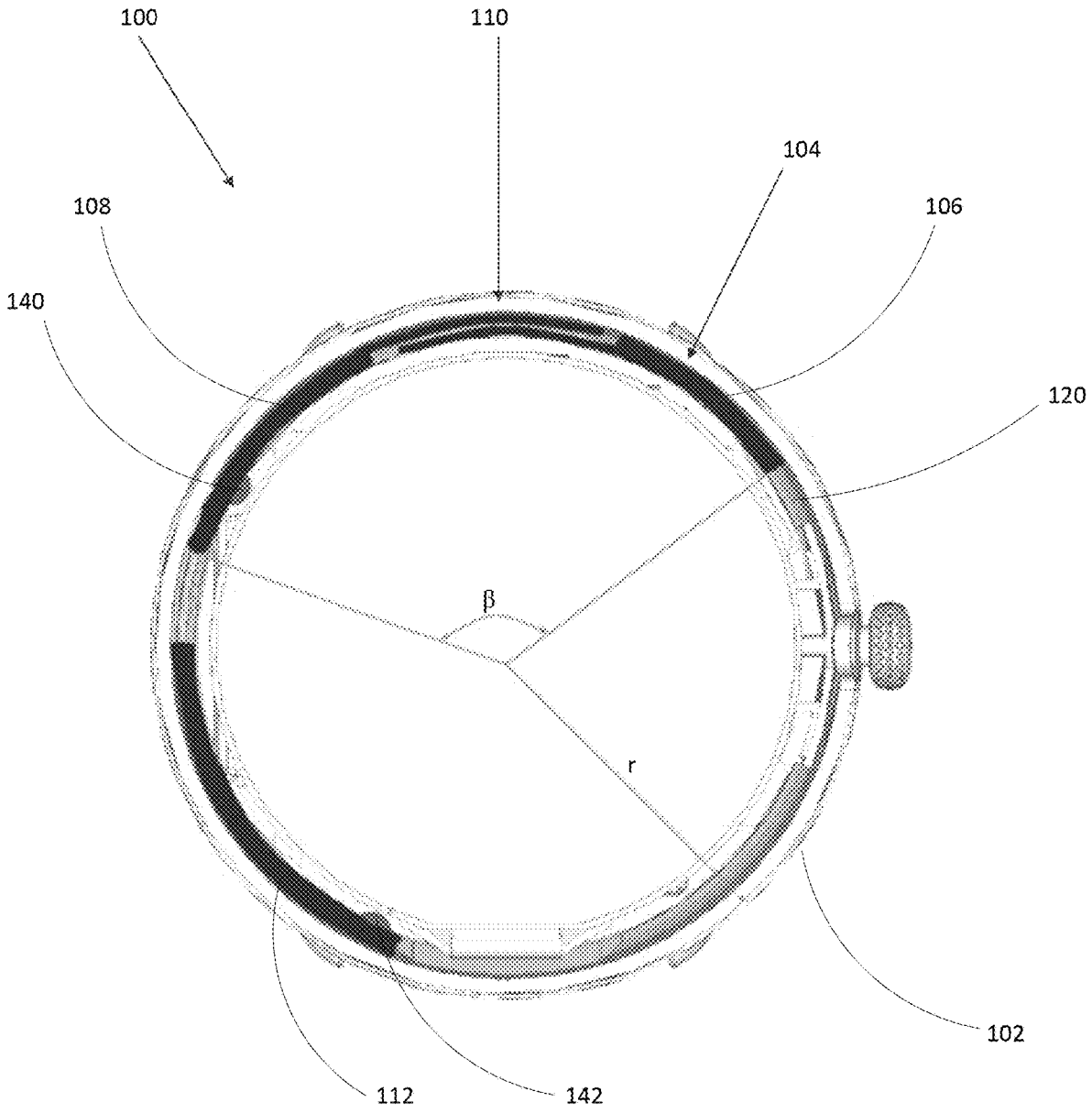
FIG. 6 is a top view of an example antenna configuration according to aspects of the disclosure.

FIG. 6 illustrates a top view of an example antenna configuration. According to the example configuration in FIG. 6, the carrier 120 does not extend around the entire periphery of housing 102 and the inner trace 106 and outer trace 108 of the first antenna 104 are not touching. The second antenna 112 may be in proximity to the first antenna 104 along carrier 120. According to some examples, the second antenna 112 may have a shorter length than the first antenna 104. In other examples, the second antenna 112 may be the same length or longer than the first antenna 104. The first antenna 104 may have a length proportional to angle "β" and radius "r", where Angle "β" represents the angle between the first and second end of the first antenna 104. The length of the first antenna 104 may be equal to the arc length defined by angle "β" and radius "r." For example, angle "β" may be approximately 120 degrees, making the length of the first antenna 104 equal to approximately one-third (⅓) of the perimeter. According to some examples, the length of first antenna 104 may be between one-half and one-fourth of the periphery of the wearable device. In still other examples, the length of the first antenna 104 may be more than one-half of the periphery of the wearable device or may be less than one-fourth of the periphery. According to some embodiments, radius "r" may be equal to 20 mm. Therefore, if angle "β" is 120 degrees and radius "r" is 20 mm, the first antenna 104 would have a length of approximately 42 mm.

Figure 7:
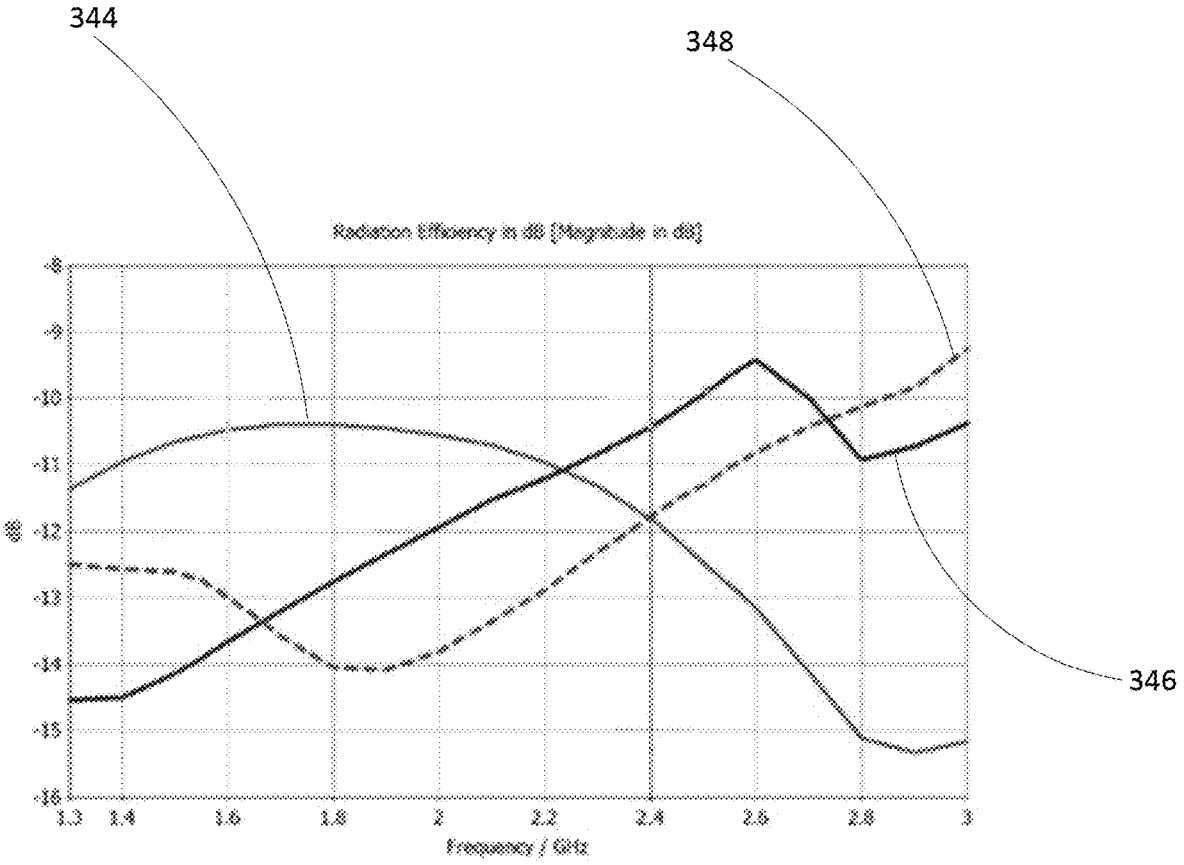
FIG. 7 is a graph illustrating performance of the first and second antennas according to aspects of the disclosure.

FIG. 7 is a graph comparing antenna performance of the first antenna 104, the second antenna 112, and a prior configuration of the first antenna. In this example, the cover 126 is made of Corning® Gorilla® Glass 5, which has a dielectric constant of 6.99 and a loss tangent of 0.012. The watch band, in this example, is a leather band. Further, the touch panel conductivity is 100 s/m. Curve 344 indicates a radiation efficiency of the first antenna 104 (the GPS antenna), curve 346 indicates a radiation efficiency of the second antenna 112 (the wireless network and/or short range wireless pairing antenna), and curve 348 indicates a radiation efficiency of a prior configuration of the first antenna (an old GPS antenna). According to this example, the maximum efficiency of the first antenna 104 (curve 344) occurs at a frequency of approximately 1.7 GHz, and the efficiency drops as the frequency increases. After a minimum efficiency at approximately 2.9 GHz, the efficiency of the first antenna 104 (curve 344) increases again. Curve 348 (indicating efficiency of a prior configuration of the first antenna), in contrast to curve 344, approaches its lowest efficiency as the first antenna 104 (curve 344) approaches its maximum efficiency. Thus, in this example, the first antenna 204 for GPS is more efficient at a lower frequency. Maximum efficiency for the second antenna 112 (curve 346) occurs at a frequency of approximately 2.6 GHz.

The antenna design described above provides for efficient operation of devices, particularly for small factor wearable electronic devices. Each antenna is small enough to fit inside a smartwatch, and is compatible with other components within the watch. Having a coupled loop antenna for GPS and a monopole antenna for wireless networks and/or short range wireless pairing minimizes the interference between the two antennas. The antennas may also be arranged in the smartwatch in a way to increase performance and efficiency within each antenna's frequency band. Thus, the antenna design is robust to handle the modularity of the smart watch.

Unless otherwise stated, the foregoing alternative examples are not mutually exclusive, but may be implemented in various combinations to achieve unique advantages. As these and other variations and combinations of the features discussed above can be utilized without departing from the subject matter defined by the claims, the foregoing description of the embodiments should be taken by way of illustration rather than by way of limitation of the subject matter defined by the claims. In addition, the provision of the examples described herein, as well as clauses phrased as "such as," "including" and the like, should not be interpreted as limiting the subject matter of the claims to the specific examples; rather, the examples are intended to illustrate only one of many possible embodiments. Further, the same reference numbers in different drawings can identify the same or similar elements.

The invention claimed is:

1. An antenna, comprising:

an inner trace, the inner trace having a first end and a second end;

an outer trace, the outer trace having a first end and a second end, the first end of the outer trace positioned adjacent to the second end of the inner trace, and the second end of the outer trace coupled to a feed for the antenna;

wherein the inner trace and the outer trace are positioned along a periphery of a wearable device and coupled to a ground; and wherein the antenna is a coupled loop antenna.

2. The antenna of claim 1, wherein the antenna is positioned in proximity to a second antenna of a different type without causing interference between the antenna and the second antenna.

3. The antenna of claim 2, wherein the antenna has a length between one-half and one-fourth of the periphery of the wearable device.

4. The antenna of claim 1, wherein the wearable device is a smartwatch.

5. The antenna of claim 1, wherein the antenna is configured to be coupled to a carrier within the wearable device, the carrier having an inner leg and an outer leg, the outer leg is next to the inner leg, the inner leg and the outer legs connected at an apex by an arcuate surface.

6. A wearable device, comprising:

a housing shaped to be worn on a human body, the housing having at least one outer surface and an internal cavity, wherein the at least one outer surface of the housing is shaped to come in contact with the human body;

a cover configured to enclose the internal cavity of the housing;

a carrier, the carrier positioned within the internal cavity of the housing along a periphery of the internal cavity;

a first antenna for a first frequency band, the first antenna being a coupled loop antenna attached to the carrier at a first location, the first antenna comprising:

an outer trace, the outer trace having a first end and a second end, wherein the first end of the outer trace is coupled to a feed for the first antenna; and an inner trace, the inner trace having a first end positioned adjacent to the second end of the outer trace.

7. The wearable device of claim 6, wherein the carrier has an inner leg and an outer leg, the outer leg is angled towards the inner leg, the inner leg and the outer leg connected at an apex by an arcuate surface.

8. The wearable device of claim 6, wherein the first antenna has a length between one-half and one-fourth of the periphery of the wearable device.

9. The wearable device of claim 6, further comprising a second antenna, the second antenna being a monopole antenna and attached to the carrier at a location in proximity to the first antenna.

10. The wearable device of claim 9, wherein the first antenna and second antenna share a common ground.

11. The wearable device of claim 10, wherein the common ground is the housing.

12. A system, comprising:

a first antenna for a first frequency band, the first antenna being a coupled loop antenna having an inner trace and an outer trace, the outer trace having a first end coupled to a feed for the first antenna and the inner trace having a first end positioned adjacent to the second end of the outer trace;

a second antenna for a second frequency band, the second antenna being a monopole antenna having a first end configured to serve as a feed for the first antenna; and wherein the first and second antennas are positioned along a periphery of a wearable device and coupled to a common ground.

13. The system of claim 12, wherein the first antenna has a length between one-half and one-fourth of the periphery of the wearable device.

14. The system of claim 12, wherein the first antenna is a GPS antenna.

15. The system of claim 12, wherein the wearable device is a smartwatch.

16. The system of claim 15, wherein the smartwatch includes a housing, the housing being insertable into a variety of different watchbands, the variety of different watchbands comprised of a variety of different materials.

17. The system of claim 12, wherein the first antenna is positioned in proximity to the second antenna without causing interference between the first and second antennas.

18. The system of claim 12, wherein the outer trace has a second end and the inner trace has a first end, the second end of the outer trace is positioned adjacent to the first end of the inner trace.

19. The system of claim 12, wherein the first and second antennas are configured to be coupled to a carrier within the wearable device, the carrier having an inner leg and an outer leg, the outer leg is next to the inner leg, the inner leg and the outer legs connected at an apex by an arcuate surface.

20. The antenna of claim 1, wherein the inner trace and the outer trace form separate structures.

21. The antenna of claim 20, wherein the inner trace is aligned with the outer trace without the inner trace and outer trace touching each other.

* * * * *